United States Patent [19]

Keener

[11] Patent Number: 4,970,742

[45] Date of Patent: Nov. 20, 1990

[54] MULTI-SECTIONAL BACK REST AND PILLOW HAVING THE CAPABILITY OF ASSUMING A SERIES OF DIFFERENT CONFIGURATIONS

[76] Inventor: Eugene R. Keener, 3400 Yelverton Cir., Raleigh, N.C. 27612

[21] Appl. No.: 518,744

[22] Filed: May 3, 1990

[51] Int. Cl.[5] ..... A47C 20/00

[52] U.S. Cl. ..... 5/431; 5/432; 5/465; 5/437

[58] Field of Search ..... 5/431–433, 5/437, 465, 481

[56] References Cited

U.S. PATENT DOCUMENTS

| | | | |
|---|---|---|---|
| 2,593,319 | 4/1952 | Levitin et al. | 5/437 |
| 3,333,286 | 8/1967 | Biolik | 5/437 X |
| 3,742,526 | 7/1973 | Lillard | 5/465 |
| 4,393,530 | 7/1983 | Stark | 5/437 |
| 4,853,993 | 8/1989 | Walpin et al. | 5/465 X |

FOREIGN PATENT DOCUMENTS

| | | | |
|---|---|---|---|
| 242467 | 11/1925 | United Kingdom | 5/465 |

*Primary Examiner*—Michael F. Trettel

*Attorney, Agent, or Firm*—Rhodes, Coats & Bennett

[57] ABSTRACT

The present invention entails a wedge shaped multi-sectional back rest pillow unit wherein at least one section of the unit is movable such that the overall structure may be manipulated such that it can assume numerous different configurations. By selectively moving and repositioning one section of the back rest and pillow unit, the entire structure may assume: (1) an upright back rest configuration, (2) an intermediate back rest configuration, (3) a horizontal wedge configuration, or (4) a pillow configuration.

10 Claims, 9 Drawing Sheets

MULTI-SECTIONAL BACK REST AND PILLOW HAVING THE CAPABILITY OF ASSUMING A SERIES OF DIFFERENT CONFIGURATIONS

FIELD OF THE INVENTION

The present invention relates to pillows and more particularly to multi-sectional pillows that have the capability of assuming different overall pillow configurations.

BACKGROUND OF THE INVENTION

Back rest and pillows are available in many different sizes and configurations and can be used in a variety of ways. For example, there is commercially available back rests that can be used by individuals on a bed, sofa, within a chair, etc. These back rests are available in many sizes and shapes. But for the most part, back rests that are known and used today are simply back rests and are not generally functional as comfortable pillows and especially not functional as a bed pillow. This has the potential to lead to inconvenience in situations where an individual utilizes a conventional back rest or wedge about his or her bed. This is because both the back rest and a conventional pillow is required, and in order to move from the back rest to a pillow requires that the back rest be set aside and the pillow appropriately positioned on the bed.

Therefore, there has been and continues to be a need for a convertible pillow structure that has the capability of serving multi-functions, particularly the capability to serve as a back rest and a conventional bed pillow.

SUMMARY AND OBJECTS OF THE INVENTION

The present invention entails a multi-sectional pillow that has the capability to function as a back rest or as bed pillow. Moreover, the design of the multi-sectional pillow of the present invention is such that the pillow itself may be converted from back rest configuration to a pillow configuration and wherein the multi-sectional pillow can be appropriately supported and used on a conventional bed in either configuration.

In a preferred embodiment disclosed herein, the multi-sectional back rest pillow of the present invention assumes an overall wedge shape. A lower portion of the overall wedge pillow design includes a movable section that can be moved from a lower base position to a rotated or offset position where the same lower section is stationed adjacent the back of what is referred to as the upper wedge section. In this position, the total pillow structure can be appropriately positioned or oriented such that it may serve as an intermediate back rest or as a conventional head pillow. When the lower section is rotated to its normal or initial base position, the total pillow configuration assumes a wedge shape. In this wedge shape configuration the total pillow structure can be positioned such that it assumes a full upright back rest position or the total pillow can be horizontally disposed such that it can serve as a generally horizontal wedge shape support for a person lying on a bed, sofa or the like.

It is therefore an object of the present invention to provide a multi-sectional pillow that has the capability of being transformed into a plurality of different configurations.

Another object of the present invention resides in the provision of a multi-sectional pillow that can be configured into either a back rest or a head pillow configuration and wherein the multi-sectional pillow is compatible for use in conjunction with a bed as both a back rest and a conventional head pillow.

A further object of the present invention resides in the provision of a multi-sectional pillow of a character referred to above that is compact, easy to handle, and relatively simple in design.

A further object of the present invention resides in the provision of a multi-sectional back rest and pillow of the character referred to above that is relatively soft and comfortable about areas contacted by the human body.

Still a further object of the present invention resides in the provision of a multi-sectional pillow of the character referred to above that is transformable into at least three basic configurations; an upright back rest configuration, a horizontal wedge type configuration, and a pillow configuration.

It is also and object of the present invention to provide a combination bed rest and pillow in the form of a single pillow type structure that provides comfortable cushioning for a person's back and head for a variety of anatomical positions commonly assumed in sleeping, resting, reading, conversing, reviewing and eating.

Other objects and advantages of the present invention will become apparent and obvious from a study of the following description and the accompanying drawings which are merely illustrative of such invention.

DESCRIPTION OF THE INVENTION

Figure 1:
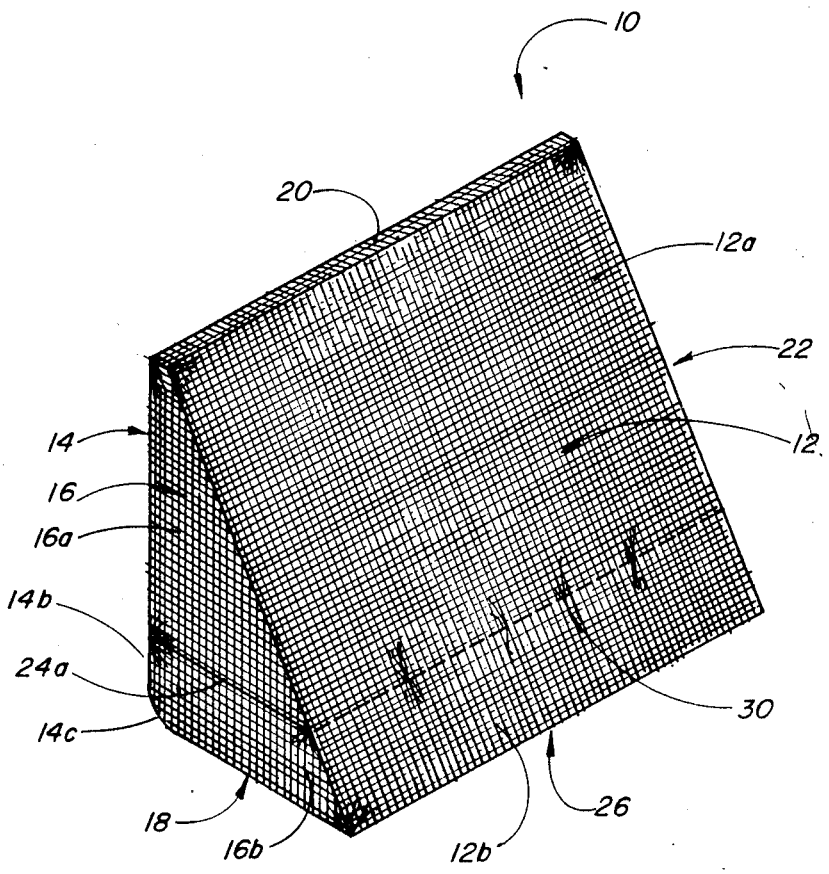
FIG. 1 is a perspective view of the combination back rest and pillow unit of the present invention shown in an upright back rest configuration.
Figure 10:
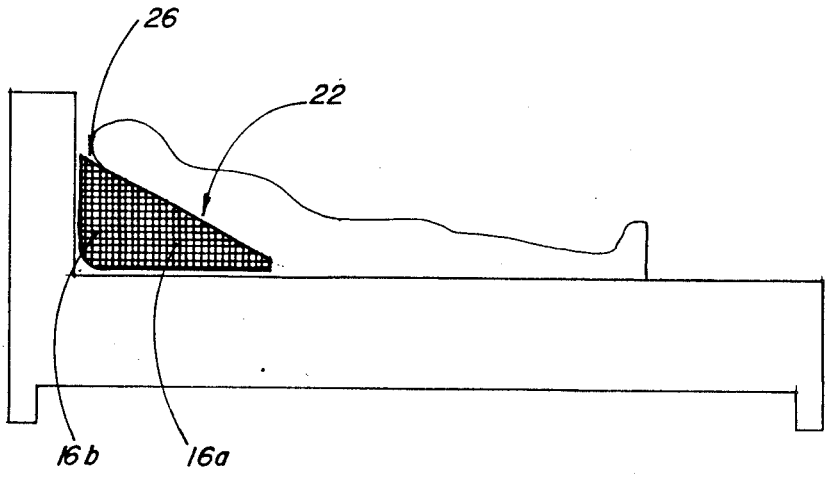
FIG. 10 is a schematic illustration of the combination back rest and pillow unit of FIGS. 1–3 shown in a horizontal wedge support configuration.

With further reference to the drawings, the combination back rest and pillow of the present invention is shown therein and indicated generally by the numeral 10. Viewing the combination back rest and pillow 10, it is seen that the same as shown in FIG. 1 assumes a wedge shaped configuration and as such forms a complete back rest or wedge support. Accordingly, the complete combination back rest and pillow as shown in FIG. 1 will be described. In this regard, the back rest and pillow unit 10 includes an inclined support surface 12, a back 14, a pair of sides 16, a bottom 18, and an upper edge 20. In this configuration the combination back rest and pillow can be used as a back rest (FIG. 8) or can be used as a horizontal wedge support on a bed (FIG. 10).

Figure 2:
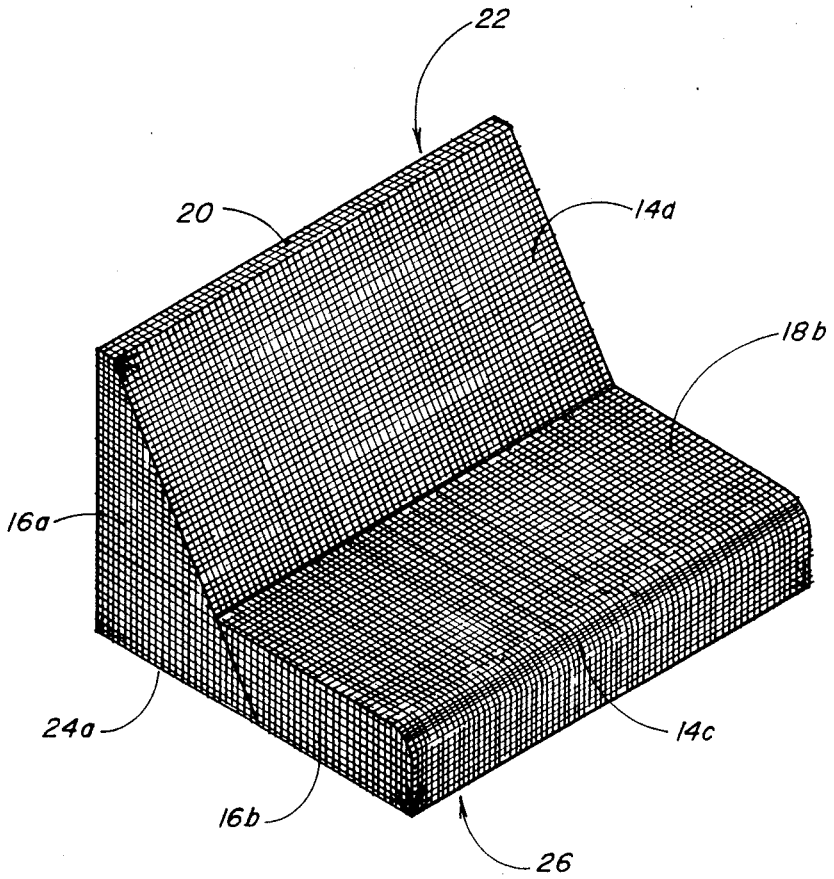
FIG. 2 is a perspective view of the combination back rest and pillow unit of the present invention wherein a lower pillow section has been rotated to assume an offset position giving rise to a pillow configuration.

As seen in FIGS. 1 and 2, the combination back rest and pillow basically comprises two sections, a first section which is also referred to as an upper wedge section and which is indicated generally by the numeral 22, and a pillow section indicated generally by the numeral 26. As will be appreciated from subsequent portions of this disclosure, the base or pillow section 26 is movably mounted with respect to the first or upper wedge section 22 and therefore can assume a position aligned with the first or upper wedge section 22 (FIG. 1) or an offset position where the base or pillow section 26 lies adjacent the back portion of the first or upper wedge section 22 (FIG. 2).

Now viewing the first or upper wedge section 22, it is seen that the same includes an inclined surface **12*a*, a back 14*a*, a pair of sides 16*a*, and a bottom side 24*a*. It is noted that the bottom side 24*a* rests atop the base or pillow section 26 when the pillow section assumes an aligned position with respect to the upper wedge section 22**.

Now referring to the base or pillow section 26, it is seen that the same includes an inclined surface **12*b*, a back area 14*b*, an arcuate shaped or curved edge 14*c*, a pair of sides 16*b*, a bottom 18*b*, and a top 28*b*. It is seen that top 28*b* rests flush adjacent bottom 24*a* forming a part of the first or upper wedge section 22**.

As pointed out above, the base section 26 is movable with respect to the upper wedge section 22, thereby giving the combination back rest and pillow unit 10 the capability of assuming numerous different configurations (see FIGS. 7–10) In order to movably mount base section 26 to the upper wedge section 22, there is provided a transverse pivot seam 30 that extends across the back 14 of the combined back rest and pillow unit 10. In particular, the combination back rest and pillow unit is provided with a fabric covering that extends over cushion type material. In the embodiment illustrated in FIGS. 1 and 2, the pivot seam 30 is formed in the fabric covering extending across the back 14 of the combination back rest and pillow 10. Essentially, a pair of fabric panels are pulled together and stitched along seam 30 to form a pivot seam or axis that alows the base or pillow section 26 to rotate from its complimentary wedge position (FIG. 1) to an offset pillow position (FIG. 2).

Figure 3:
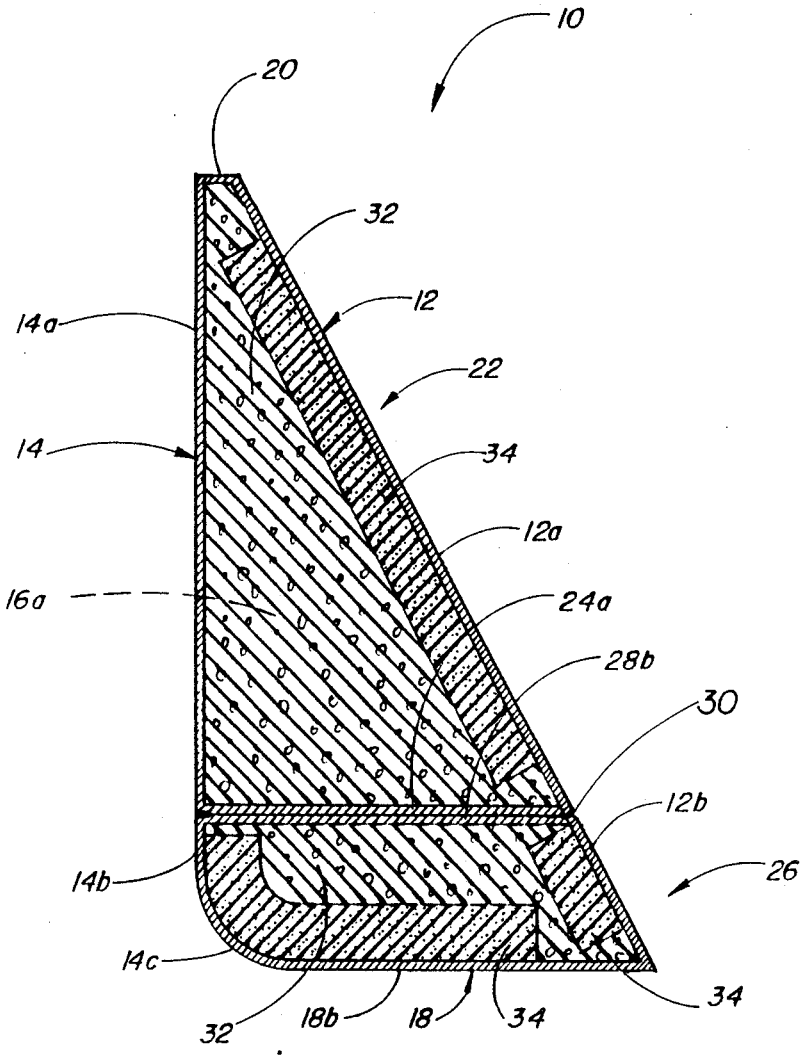
FIG. 3 is a vertical cross-sectional view of the combination back rest and pillow unit shown in FIG. 1.

As shown in FIG. 3, the combination back rest and pillow 10 includes internal cushion like material that serves to form and hold the shape of the unit 10 as well as to serve as a soft cushioning structure for a person's body to bear against. In the embodiments illustrated, there are two types of internal foam material. First, there is a relatively firm or dense foam material, indicated by the numeral 32. This relatively firm or dense foam material serves to retain and hold the shape of the entire back rest and pillow unit 10 as well as also serving as a resilient or cushioning material. The relatively firm or dense foam sections 32 include selected cutout areas adjacent portions of the back rest and pillow unit that engage and support the body during use. These cutouts are filled with a relatively soft or less dense foam insert panel indicated by the numeral 34. As seen in FIG. 3, these relatively soft or less dense foam insert panels assume positions adjacent the inclined surface **12*a* and 12*b*. In addition, there is a relatively soft or less dense foam insert panel 34 that extends adjacent the bottom 18*b*, curved edge 14*c* and back 14*b* of the lower section 26**.

Figure 4:
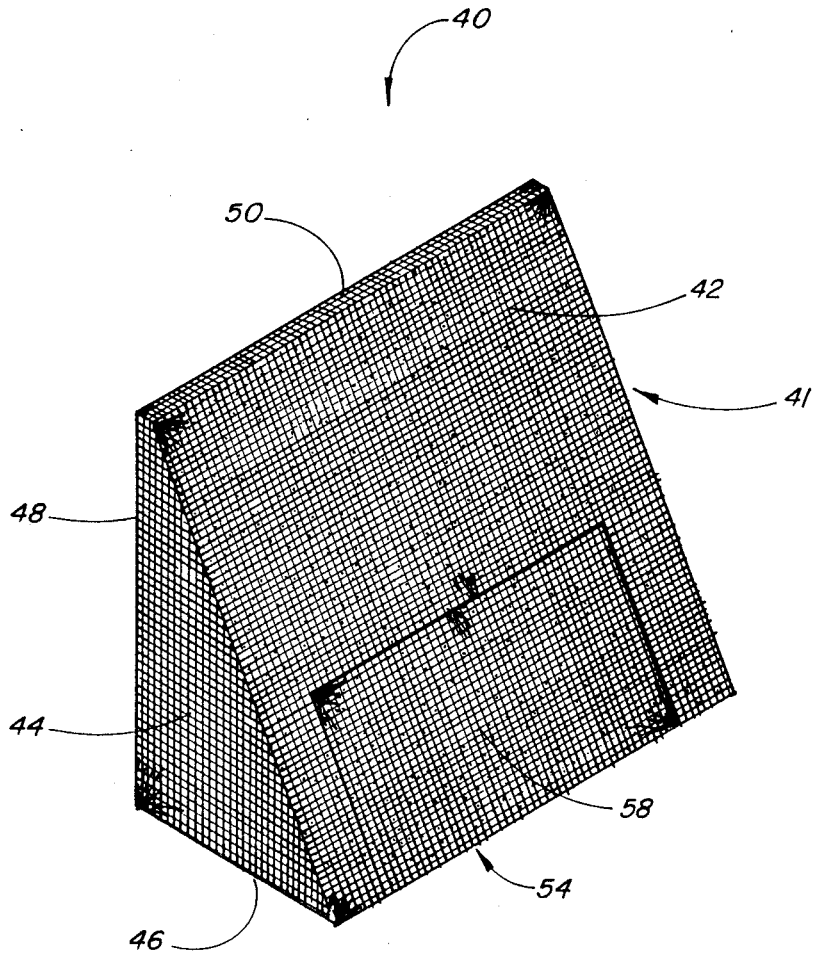
FIG. 4 is a perspective view of a second design for the combination back rest and pillow unit of the present invention.
Figure 5:
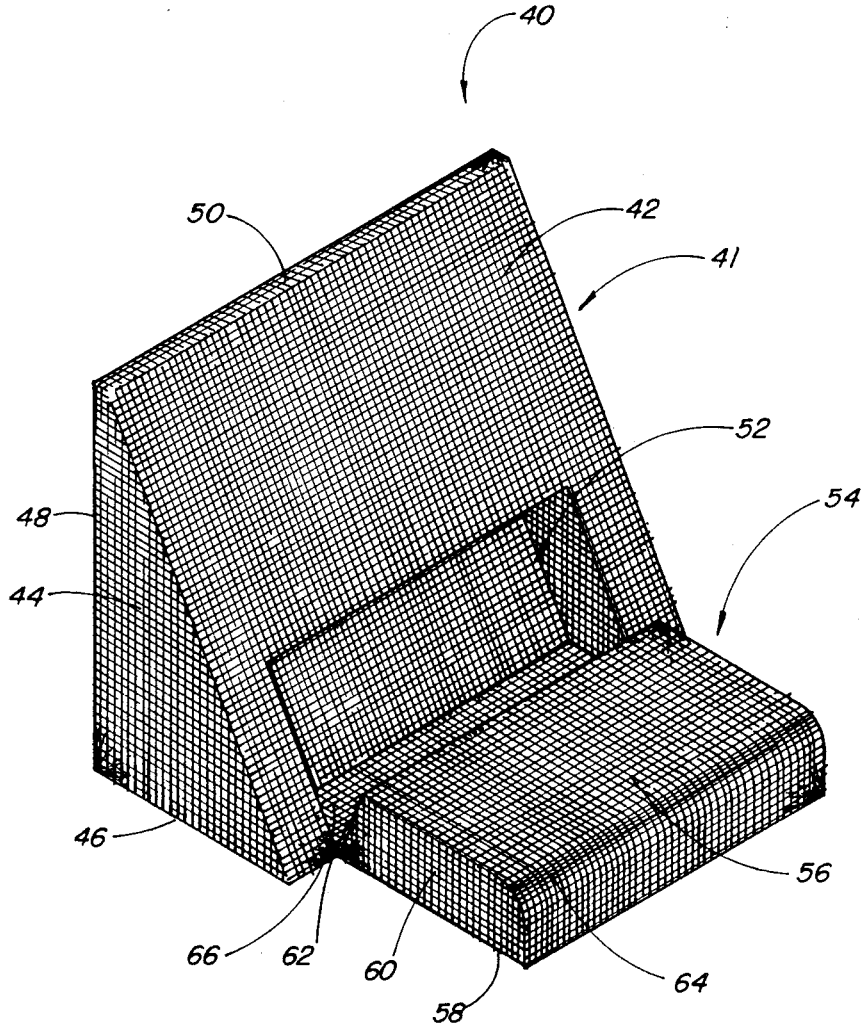
FIG. 5 is a perspective view of the second design shown in FIG. 4, with the pillow section being extended outwardly from the basic wedge structure, giving rise to a pillow use configuration.
Figure 6:
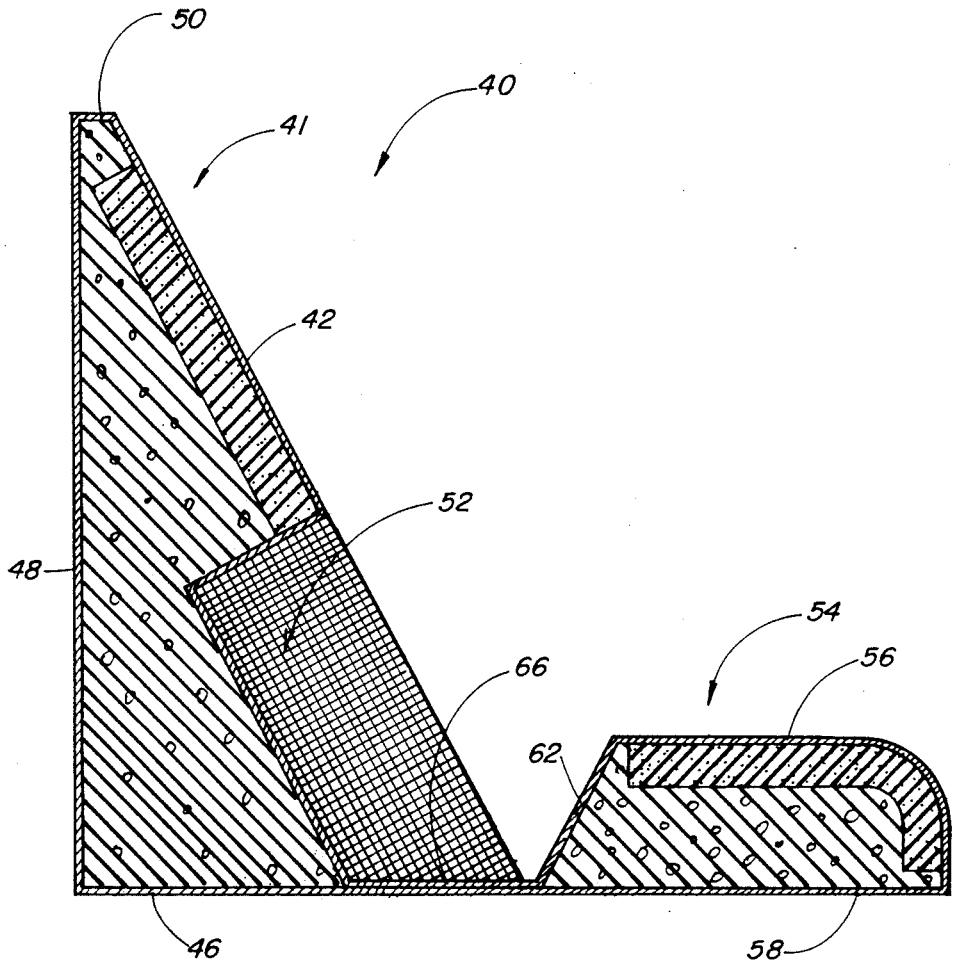
FIG. 6 is a vertical sectional view showing the second design for the combination back rest and pillow unit shown in FIG. 5.

Turning to FIGS. 4–6, another design for the combination back rest and pillow unit is shown and in this case, the combination back rest and pillow unit is indicated generally by the numeral 40. This combination back rest and pillow unit 40 includes a first or wedge section indicated generally by the numeral 41 and a pull out pillow section indicated generally by the numeral 54. Viewing the first or wedge section 41, it is seen that the same assumes a generally wedge shape and includes an inclined forward surface 42, pair of sides 44, bottom 46, back 48, and an upper edge 50. Formed in the lower central portion along the inclined surface 42 is a pillow cutout 52 that is designed to receive and hold pillow section 54.

Pillow section 54 includes a top 56, bottom 58, sides 60, back 62, and a curved forward edge 64. As was the case with the embodiment shown in FIGS. 1–3, the embodiment or design shown in FIGS. 4–6 is provided with a pillow section 54 that is capable of moving from a first position where it assumes a part of an overall wedge configuration (FIG. 4) to an exposed or extended pillow position where the pillow section 54 lies outside the basic wedge configuration (FIG. 5). In order to provide for the movement of pillow section 54, there is provided a connecting fabric panel 66 that is interconnected between the pillow section 54 and the first or wedge section 41. Note in FIG. 6 that the connecting panel 66 is connected to the wedge section 41 about the lower inside portion of the pillow cutout 52. The same connecting panel 66 is connected to the lower left most edge of the pillow section 54, as shown in FIG. 6.

Figure 8:
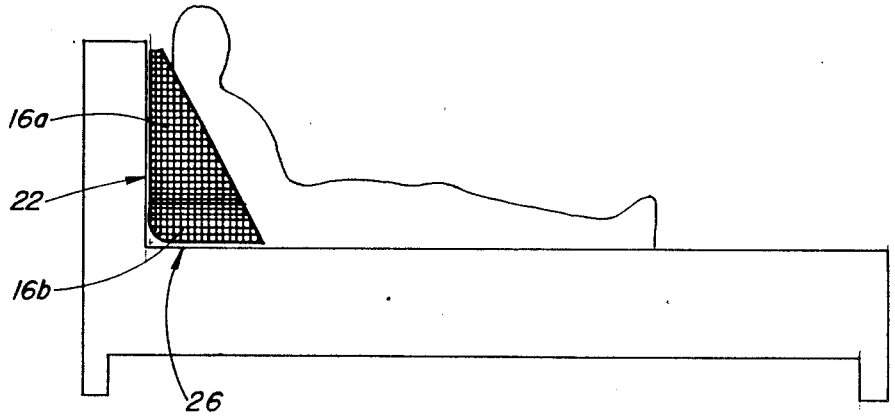
FIG. 8 is a schematic illustration showing the combination back rest and pillow unit of FIGS. 1–3 disposed in a full upright back rest configuration.
Figure 9:
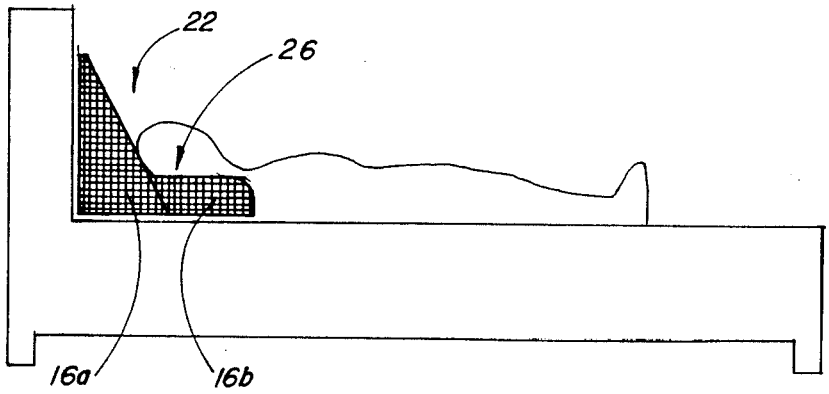
FIG. 9 is a schematic illustration of the combination back rest and pillow unit of FIGS. 1–3 showing the unit in a pillow extended configuration.

In use, the combination back rest and pillow 10, or the second design indicated generally by the numeral 40, can be manipulated to assume numerous different and distinct configurations to support a person in a plurality of anatomical positions. For example, the combination back rest and pillow 10 can be positioned on a bed as shown in FIG. 8 to assume a full upright back rest configuration. In that configuration, the upper wedge shaped section 22 and the lower base section 26 are aligned and the person's back rests adjacent the inclined forward surface 12. That same configuration can be repositioned on a bed to form a horizontal wedge support configuration, as shown in FIG. 10.

Figure 7:
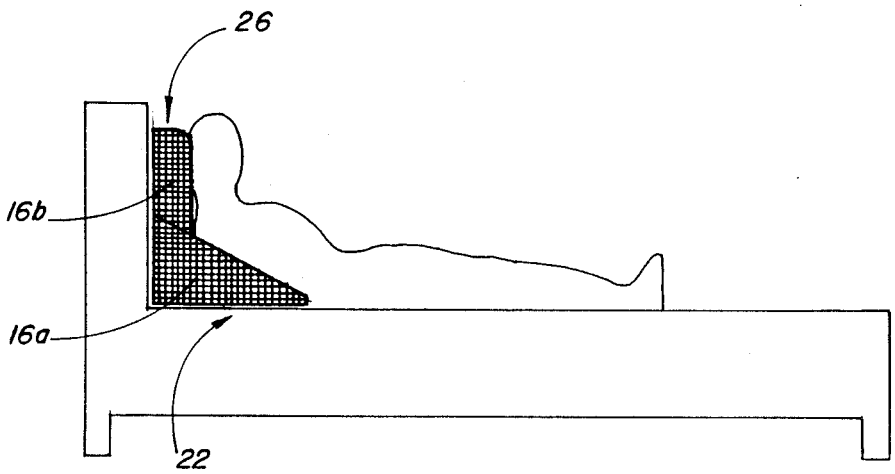
FIG. 7 is a schematic view illustrating the combination back rest and pillow unit of FIGS. 1–3 shown in an intermediate back rest configuration.

As indicated in FIG. 2, the base section 26 can be rotated to its offset, pillow extended position. In this configuration, the pillow section 26 can be used as a conventional pillow. See FIG. 9 for an example of the back rest and pillow unit being used in this configuration. This configuration can be rearranged on the bed to form what is referred to as an intermediate back rest position. This is illustrated in FIG. 7. Note in this configuration, that the upper wedge section 22 is laid on its back 14*a* while the pillow section 26 projects generally vertically from the upper section 22. In this configuration, a person's upper back and head can be supported or rested against the inclined surface 12*a* and bottom 18*b* of the base section 26.

With respect to the second design shown in FIGS. 4–6, it is appreciated that in the configuration shown in FIG. 4 that the combination back rest and pillow unit assumes a full upright back rest configuration or a generally horizontal support configuration such as shown in FIGS. 8 and 10 respectively. In addition, the pillow section 54 can be pulled from the cutout 52 and extended such that the pillow section 54 itself may be used as a pillow.

Figure 11:
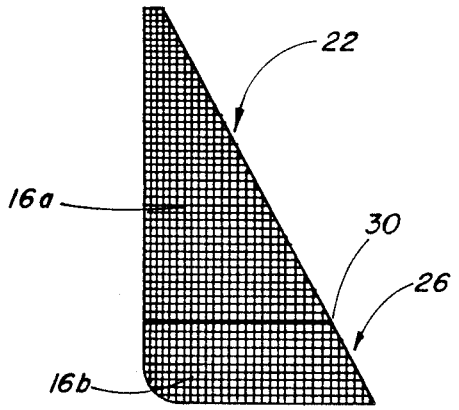
FIG. 11 is a side elevational view of the combination back rest and pillow unit of the present invention with the lower pillow section being disposed in a lower aligned position.
Figure 12:
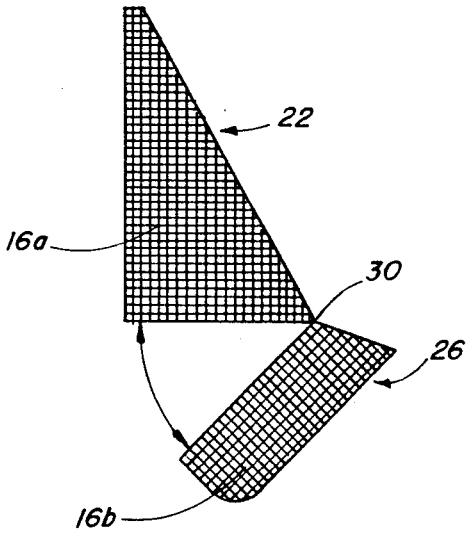
FIG. 12 is a side elevational view of the combination back rest and pillow unit shown in FIG. 11 with the lower pillow section being rotated counterclockwise toward an extended pillow position.
Figure 13:
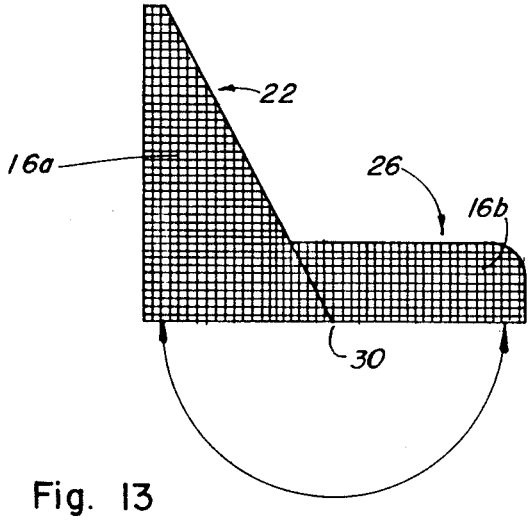
FIG. 13 is a side elevational view of the combination back rest and pillow unit shown in FIGS. 11 and 12 with the pillow section assuming the pillow extended position.

In FIGS. 11–13, the combination back rest and pillow unit 10 shown in FIGS. 1–3 is again illustrated. These views show the rotation of the pillow section 26 from its lower base position where it aligns with the upper section 22.

From the foregoing specification and discussion, it is appreciated that the combination back rest and pillow unit of the present invention can be utilized to assume a plurality of different configurations and can be used in conjunction with a bed, sofa, chair or the like to support a person in a series of various anatomical positions. The combination back rest and pillow unit of the present invention is especially beneficial in that the total unit serves a series of purposes and accordingly can be used on a bed as a full back rest, a pillow, an intermediate back rest, or a horizontal wedge support.

The present invention may, of course, carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A dual sectional combination backrest and pillow that is convertible from a wedge shaped back rest configuration to an extended pillow configuration comprising:

(a) an upper wedge shaped section including an inclined surface having a lower portion, a back and a bottom;

(b) a base section movably connected about the bottom of the upper wedge shaped section and including an inclined surface, a top, a back, and a bottom;

(c) means for rotatively mounting the base section to the upper wedge section such that the base section may be moved from a first position where it aligns with the upper wedge section to an offset position where the pillow section extends outwardly from the lower portion of the inclined surface of the upper section;

(d) wherein in the first position the top of the base section extends adjacent to and parallel with the bottom of the upper wedge section, while the inclined surface of the base sections extends in co-planer relationship with the inclined surface of the upper wedge section; and (e) wherein the upper wedge section and the base section include a fabric covering and wherein the means for rotatively mounting the base section to the upper wedge section includes a pivot seam formed in the fabric covering transversely across a line where the inclined surfaces of the upper wedge section and base section meet such that the base section rotates about a transverse axis that effectively joins the upper wedge section to the base section.

2. A dual sectional combination back rest and pillow that is convertible from a wedge shape back rest configuration to an extended pillow configuration comprising:

(a) an upper wedge shaped section including an inclined surface having a lower portion, a back and a bottom;

(b) a base pillow section movably connected about the bottom of the upper wedge shaped section and including an inclined surface, a top, a back, and a bottom;

(c) means for rotatively mounting the base pillow section to the upper wedge section such that the base pillow section may be moved from a first position where it aligns with the upper wedge section to form a wedge shaped back rest to an offset pillow position where the pillow section extends outwardly from the lower portion of the inclined surface of the upper section; and (d) wherein in the first position the top of base pillow section extends adjacent to and parallel with the bottom of the upper wedge section, while the inclined surface of the base pillow section is aligned with and extends in co-planer relationship with the inclined surface of the upper wedge section.

3. The dual sectional combination back rest and pillow of claim 2 wherein the means for rotatively mounting the base pillow section to the upper wedge section includes a pivot seam extending transversely across the inclined surfaces of the upper wedge section and the base pillow section.

4. The combination back rest and pillow of claim 3 wherein the base pillow section includes a generally curved surface disposed opposite the pivot seam such that when the base section is rotated to the offset position the generally curved surface assumes an outer upper position for receiving and supporting the head of a person.

5. The dual sectional combination back rest and pillow of claim 2 including an internal cushion-like material and an outer fabric covering.

6. The dual sectional combination back rest and pillow of claim 5 wherein the internal cushion material includes a first relatively firm foam-like material that is sufficiently firm to form and hold the shape of the combination back rest and pillow, and a second relatively soft foam-like material disposed adjacent the inclined surface of both the upper wedge shaped section and base pillow section for providing a relatively soft and comfortable support surface.

7. The dual sectional combination back rest and pillow of claim 6 wherein the relatively soft foam-like material extending adjacent the inclined support surface of both the wedge shaped section and the base pillow section also extends adjacent the bottom of the base pillow section such that when the base pillow section is rotated to its offset pillow position, the relatively soft foam-like material lies adjacent the then exposed upper surface of the base pillow section which now functions as a head pillow.

8. The combination pillow and back rest of claim 2 wherein the base pillow section includes a generally curved surface that forms a head rest area about the base section when the same assumes its offset pillow position.

9. The combination back rest and pillow of claim 2 wherein the base pillow section includes a generally curved surface and wherein when the pillow base section is rotated to the offset pillow position the generally curved surface assumes an outer upper position for receiving and supporting the head of a person.

10. A multi-sectional combination back rest and pillow which can be readily converted from a back rest to a pillow configuration and vice versa comprising:

(a) a main support structure having an internal cushion material and an outer fabric covering and adapted to assume a wedge shaped configuration for functioning as an upright back rest or as a horizontal wedge support;

(b) the main support structure including an upper wedge shaped section including an inclined surface having a lower portion, a back, and a bottom;

(c) the main support structure further including a base pillow section movably connected about the bottom of the upper wedge shaped section and including an inclined surface, a top, a back and a bottom;

(d) means for rotatively mounting the base pillow section to the upper wedge section such that the base pillow section may be moved from a first position where it aligns with the upper wedge section to an offset pillow section where the pillow section extends outwardly from the lower portion of the inclined surface of the upper section; and (e) wherein in the first position the top of the base pillow section extends adjacent and parallel to the bottom of the upper wedge section, while the inclined surface of the base pillow section extends in co-planer relationship with the inclined surface of the upper wedge section.

* * * * *